US006341973B1

(12) United States Patent
Endo

(10) Patent No.: US 6,341,973 B1
(45) Date of Patent: Jan. 29, 2002

(54) HALF-FITTING PREVENTION CONNECTOR FOR DETECTING AND PREVENTING HALF-FITTED CONDITION

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/659,611

(22) Filed: Sep. 11, 2000

(30) Foreign Application Priority Data

Sep. 20, 1999 (JP) ..... 11-265829
Jun. 26, 2000 (JP) ..... 12-191558

(51) Int. Cl.[7] ..... H01R 13/627
(52) U.S. Cl. ..... 439/352; 439/350; 439/353
(58) Field of Search ..... 439/352, 350, 439/351, 353, 354, 357, 358

(56) References Cited

U.S. PATENT DOCUMENTS 5,722,849 A * 3/1998 Alwine ..... 439/352
5,820,399 A 10/1998 Shirouzu et al. ..... 439/352
5,848,912 A * 12/1998 Okabe ..... 439/489
5,919,056 A * 7/1999 Suzuki et al. ..... 439/352
5,938,466 A 8/1999 Suzuki et al. ..... 439/352
6,036,524 A 3/2000 Suzuki et al. ..... 439/354
6,065,991 A * 5/2000 Fukuda ..... 439/352
6,077,101 A * 6/2000 Garretson et al. ..... 439/352
6,102,726 A * 8/2000 Tsuji et al. ..... 439/352
6,106,321 A * 8/2000 Yoshida et al. ..... 439/352
6,135,802 A * 10/2000 Nakamura ..... 439/352

FOREIGN PATENT DOCUMENTS

| | | |
|---|---|---|
| EP | 1 001 500 A1 | 5/2000 |
| JP | 9-55261 | 2/1997 |
| JP | 10-50408 | 2/1998 |

* cited by examiner

*Primary Examiner*—P. Austin Bradley
*Assistant Examiner*—Truc Nguyen
(74) *Attorney, Agent, or Firm*—Sughrue Mion, PLLC

(57) ABSTRACT

A male connector housing (41) has an elastic lock arm (44) extending in a fitting direction, and a return spring (46) is supported on the lock arm (44) so as to be contracted along a length of the lock arm (44). A female connector housing (42) includes an arm guide portion (48) for elastically deforming the lock arm (44) toward an outer surface of the housing in a half-fitted condition of the two connector housings, a spring abutment portion (50), which abuts against one end of the return spring (46) during the connector fitting operation, with the lock arm (44) elastically deformed, so as to resiliently deform the return spring (46), thereby producing a disengaging force urging the two connectors away from each other, and an arm retaining portion (52) which retains an engagement projection **(44*b*) to lock the two connector housings in a fitted condition when the two connector housings are completely fitted together as a result of cancellation of the elastic deformation of the lock arm (44)**.

10 Claims, 17 Drawing Sheets

HALF-FITTING PREVENTION CONNECTOR FOR DETECTING AND PREVENTING HALF-FITTED CONDITION

BACKGROUND OF THE INVENTION

1. Field of the Invention

The present invention relates to a half-fitting prevention connector, and more particularly to a half-fitting prevention connector in which a half-fitted condition is positively prevented by a disengaging force (repelling force) produced between a pair of connector housings to be fittingly connected together.

The present application is based on Japanese Patent Application Nos. Hei. 11-265829 and 2000-191558, which are incorporated herein by reference.

2. Description of Related Art

Usually, various electronic equipments are mounted on a vehicle such as an automobile, and therefore, naturally, various types of male and female connectors are provided at connection ends of various wires forming wire harnesses or the like.

Generally, male and female connectors to be fittingly connected together are provided with a lock mechanism, in which when the amount of fitting of their connector housings relative to each other reaches a predetermined value, the two connector housings are locked together in a fittingly-connected condition.

When the connector housings of the male and female connectors are connected together by the lock mechanism, each of connection terminals in the male connector housing is electrically connected to a respective one of connection terminals in the female connector housing with adequate contact pressure and contact area.

However, for example, when the operating force for fitting the two connector housings together is inadequate, and when either of the connector housings or any of the connection terminals therein is defective, the connector fitting operation is sometimes finished in a half-fitted condition in which the amount of fitting of the two connector housings relative to each other fails to reach the predetermined value.

When the male and female connectors are used in such a half-fitted condition, they may be disengaged from each other because of vibrations, developing during use, and the tension of a wire harness, and this can lead to a disadvantage that the feeding of electric power is interrupted. Even if the two connectors are not disengaged from each other, there is a possibility that in the half-fitted condition, the mating connection terminals are incompletely electrically connected together, in which case the necessary electrical characteristics are not obtained, and this may lead to a disadvantage that the associated electric part is subjected to a malfunction.

Therefore, in order to prevent an accident due to a failure to notice such a half-fitted condition of the two connectors, there have been proposed various half-fitting prevention connectors in which the two connector housings are disengaged from each other when a half-fitted condition is encountered.

FIGS. 14 to 16 show one such conventional half-fitting prevention connector disclosed in Unexamined Japanese Patent Publication No. Hei. 10-50408. An elastic lock arm 6 is formed on a connector housing 3 of a connector 1 (one of a pair of connectors 1 and 2 to be fitted together in a male-female manner), and extends in a connector fitting direction, and an engagement projection 8 is formed on a lower surface of this lock arm 6 at a distal end thereof. A slider 10 is mounted on the connector housing 3, and is movable between a non-lock position, disposed close to the proximal end of the lock arm 6, and a lock position disposed close to the distal end of the lock arm 6. A pair of right and left spring members 9 and 9, urging the slider 10 toward the lock position, are mounted on the connector housing 3. A lock projection 7 is formed on the lock arm 6, and this lock projection 7 can abut against the slider 10, returned to the lock position, to limit the displacement of the slider 10 by the spring members 9 and 9.

Stopper projections 14 and an engagement portion 13 are formed on a connector housing 11 of the other connector 2. At an initial stage of the fitting operation of the pair of connectors 1 and 2, the stopper projections 14 abut against the slider 10 to push this slider 10 back toward the non-lock position against the bias of the spring members 9 and 9 until the amount of fitting of the two connectors 1 and 2 relative to each other reaches a predetermined value, as shown in FIG. 15. When the amount of fitting of the two connectors 1 and 2 relative to each other reaches the predetermined value, the abutment portion 13 retains the engagement projection 8 to lock the two connectors in a mutually-fitted condition, as shown in FIG. 16.

In the above half-fitting prevention connector, when the pair of connectors 1 and 2 are properly fitted together, the engaged condition of the lock arm 6, mounted on the one connector 1, is locked by the slider 10, returned under the influence of the spring members 9 and 9, as shown in FIG. 16. On the other hand, when the pair of connectors 1 and 2 are in a half-fitted condition, the two connectors are disengaged from each other by the resilient force of the spring members 9 and 9, transmitted through the slider 10, as shown in FIG. 15, thus preventing such a half-fitted condition from being overlooked.

FIGS. 17 to 18C show another conventional half-fitting prevention connector disclosed in Unexamined Japanese Patent Publication No. Hei. 9-55261. In this half-fitting prevention connector, a lock arm 26 is formed on a connector housing 23 of a connector 21 (one of a pair of connectors 21 and 22 to be fitted together in a male-female manner), and extends in a connector fitting direction. An engagement projection 26*a* is formed on an upper surface of this lock arm 26, and a pair of guide projections 26*b* and 26*b* are formed on and project laterally from opposite side edges of the lock arm 26, respectively. A single return spring 30 is mounted in a connector housing 28 of the other connector 22, and guide walls 32 are formed on this connector housing 28. When fitting the two connectors together, the return spring 30 is pressed by the engagement projection 26*a* to produce a disengaging force tending to disengage the two connectors from each other. During the time when the two housings 23 and 28 are fitted together and disengaged from each other, the guide walls 32 engage the guide projections 26*b*, respectively, to hold the lock arm 26 in a predetermined inclined condition.

In a condition shown in FIG. 18A, as the connector housing 23 of the connector 21 is inserted into the connector housing 28 of the connector 22, the guide projections 26*b* of the advancing lock arm 26 are caused to slide over the guide walls 32 through respective slanting front surfaces thereof at an initial stage of this fitting operation, so that the engagement projection 26*a* on the lock arm 26 abuts against the distal end of the return spring 30, as shown in FIG. 18B.

As a result, during the fitting operation, that is, until the amount of fitting of the two housings 23 and 28 relative to each other reaches a predetermined value, the engagement projection 26*a* compresses the return spring 30 to cause this spring 30 to produce the disengaging force. Therefore, if the fitting operation should be finished in a half-fitted condition, the two connectors are disengaged from each other, thus preventing this half-fitted condition from being overlooked.

Then, when the amount of fitting of the two connectors relative to each other reaches the predetermined value, the guide walls 32 allow the engagement projection 26*a* to be disengaged from the return spring 30 as shown in FIG. 18C, so that the disengaging force of the return spring 30 is released. During the time when the two connectors 21 and 22 are withdrawn relative to each other, the guide projections 26*b* pass under the guide walls 32, respectively, thereby preventing the return spring 30 from interfering with the engagement projection 26*a*.

In the conventional half-fitting prevention connector shown in FIGS. 14 to 16, there are many separate parts, including the pair of spring members 9 and 9 and the slider 10, which are to be incorporated in the connector housing, and therefore the number of the component parts increases, and also the number of steps of the assembling process increases, and this has invited a problem that it is difficult to reduce the cost.

On the other hand, in the conventional half-fitting prevention connector shown in FIGS. 17 and 18, any slider, separate from the connector housing, is not used, and only one spring member is required for obtaining the disengaging force. Therefore, the number of the component parts, as well as the number of steps of the assembling process, is smaller as compared with the lock mechanism shown in FIGS. 14 to 16, and therefore the cost can be reduced.

However, when fitting the two connector housings relative to each other, it is necessary to cause the guide projections 26*b* of the lock arm 26 to slide respectively over the guide walls 32 formed within the housing 28 of the other connector 22, and when disengaging the two connectors from each other, it is necessary to cause the lock arm 26 to pass under the guide walls 32.

Therefore, the amount of elastic deformation of the lock arm 26 within the mating housing is large, and a space for allowing this displacement must be secured, and this has invites a problem that the connector becomes large in size. And besides, since the amount of elastic deformation of the lock arm 26 is large, the lock arm 26 is subjected to an excessive bending force, which has led to a possibility that the lock arm 26 is damaged.

SUMMARY OF THE INVENTION

It is therefore an object of the present invention to overcome the above problems and more specifically to provide a half-fitting prevention connection of a compact, inexpensive design in which a half-fitted condition is positively prevented by a disengaging force, produced between a pair of connector housings to be fittingly connected together, without increasing the number of component parts, and the connector can be positively locked to the mating connector in a mutually-fitted condition.

To achieve the above object, according to the first aspect of the present invention, there is provided a half-fitting prevention connector which comprises a pair of connector housings fittable to each other, an elastic lock arm formed on one of the connector housings, the lock arm extending in a fitting direction of the connector housings, an engagement projection formed on the lock arm, a return spring contractibly supported on the lock arm along a longitudinal direction of the lock arm, an arm guide portion disposed on the other one of connector housings, the arm guide portion causing the lock arm to deform elastically toward an outer surface of the one of the connector housings in a half-fitted condition of the connector housings, a spring abutment portion formed on the other one of connector housings, the spring abutment portion abutting against one end portion of the return spring during connector fitting operation, so that the lock arm is elastically deformed toward the outer surface of the one of the connector housings while causing the return spring to resiliently deform, thereby producing a disengaging force urging the connector housings away from each other, and an arm retaining portion disposed on the other one of connector housings, the arm retaining portion retaining the engagement projection of the lock arm to lock the connector housings when the connector housings are completely fitted to each other after an elastic deformation of the lock arm is cancelled by the arm guide portion.

In this construction, at an initial stage of the connector fitting operation, the elastic lock arm, formed on the one connector housing, is elastically deformed toward the outer surface of the housing by the arm guide portion formed on the other connector housing.

Then, when the two connectors are fitted together, with the lock arm elastically deformed toward the outer surface of the housing, the one end of the return spring, supported on the lock arm, abuts against the spring abutment portion, formed on the other connector housing, so that the return spring is resiliently deformed, and therefore the two connectors are pushed relative to each other in the fitting direction against the bias of the return spring.

When the pushing operation is stopped in this half-fitted condition, the two connectors are pushed back relative to each other in a disengaging direction, opposite to the fitting direction, by the resilient force (bias) of the return spring urging the two connectors away from each other, and therefore this half-fitted condition can be easily detected.

Then, when the amount of fitting of the two connector housings relative to each reaches a predetermined vale, so that the two connector housings are completely fitted together, the elastic deformation of the lock arm by the arm guide portion is canceled, and the lock arm is restored into its initial position where this lock arm is spaced from the outer surface of the housing.

As a result, the return spring, held on the lock arm, moves apart from the outer surface of the housing together with the lock arm, so that the one end of the return spring is disengaged from the spring abutment portion. At the same time, the engagement projection of the lock arm is retained by the arm retaining portion formed on the other connector housing, so that the two connector housings are locked to each other in a fitted condition.

Namely, any slider, separate from the connector housing, is not used, and only one spring member is required for producing the disengaging force, and therefore the number of the component parts, as well as the number of the steps of the assembling process, is reduced, and therefore the cost can be reduced.

And besides, during the connector fitting operation and the connector disengaging operation, the lock arm is elastically deformed only in the predetermined direction relative to the arm guide portion, and the amount of elastic deformation of the lock arm can be kept to a smaller value. Therefore, damage of the lock arm due to excessive deformation is suitably prevented, and besides the size of the connector will not be increased by the provision of a space for allowing the displacement of the lock arm.

According to th e second aspect of the present invention, it is preferable that the spring abutment portion projects from an elastic portion which can be elastically displaced when the spring abutment portion is pressed through the return spring toward an inside of the other one of the connector housings in a direction substantially perpendicular to the fitting direction of the connector housings.

With this construction, even if the return spring, supported on the lock arm, is brought into engagement with the spring abutment portion when the lock arm is elastically deformed toward the outer surface of the housing to thereby disengage the engagement projection from the arm retaining portion so as to cancel the fitted condition of the two connector housings, the spring abutment portion, formed on the elastic portion, can be elastically displaced toward the inside of the housing so as not to limit the retracting movement of the return spring. Therefore, during the operation for disengaging the two connector housings from each other, the return spring will not be caught by the spring abutment portion, and therefore the operating force, required for this withdrawing operation, will not increase. Therefore, the two connector housings can be easily disengaged from each other.

According to the third aspect of the present invention, it is preferable that the return spring comprises a compression coil spring wound on the lock arm.

With this construction, merely by mounting the inexpensive compression coil spring on the lock arm, this compression coil spring can be easily supported on the lock arm so as to contract along the length of this lock arm. Therefore, the assembling operation is easy, and the cost can be further reduced.

According to the fourth aspect of the present invention, it is preferable that the half-fitting prevention connector further comprises a spring fixing portion, which is formed on a proximal end portion of the lock arm, and which limits the return spring from being biased in a direction substantially perpendicular to the fitting direction of the connector housings.

With this construction, the return spring, supported on the lock arm, is prevented from shaking upon application of external vibrations and so on. And besides, even if the two connector housings are fitted together in any posture, the return spring is prevented from being displaced or biased in a direction to decrease the amount of engagement thereof with the spring abutment portion of the mating connector housing, and therefore the more positive disengaging force can be secured.

According to the fifth aspect of the present invention, it is preferable that the half-fitting prevention connector further comprises a spring relief portion located at a distal end portion of the lock arm, the spring relief portion allowing a resilient deformation of the return spring pressed by the spring abutment portion toward an outside of the one of the connector housings in a direction substantially perpendicular to the fitting direction of the connector housings.

With this construction, even if the return spring, supported on the lock arm, is brought into engagement with the spring abutment portion when the lock arm is elastically deformed toward the outer surface of the housing to thereby disengage the engagement projection from the arm retaining portion so as to cancel the fitted condition of the two connector housings, the return spring can be elastically deformed toward the outside of the housing so as not to limit the retracting movement thereof. Therefore, during the operation for disengaging the two connector housings from each other, the return spring will not be caught by the spring abutment portion, and therefore the operating force, required for this withdrawing operation, will not increase. Therefore, the two connector housings can be easily disengaged from each other.

DETAILED DESCRIPTION OF THE PREFERRED EMBODIMENTS

1. First Embodiment

A preferred first embodiment of a half-fitting prevention connector of the present invention will now be described in detail with reference to FIGS. 1 to 7C.

Figure 1:
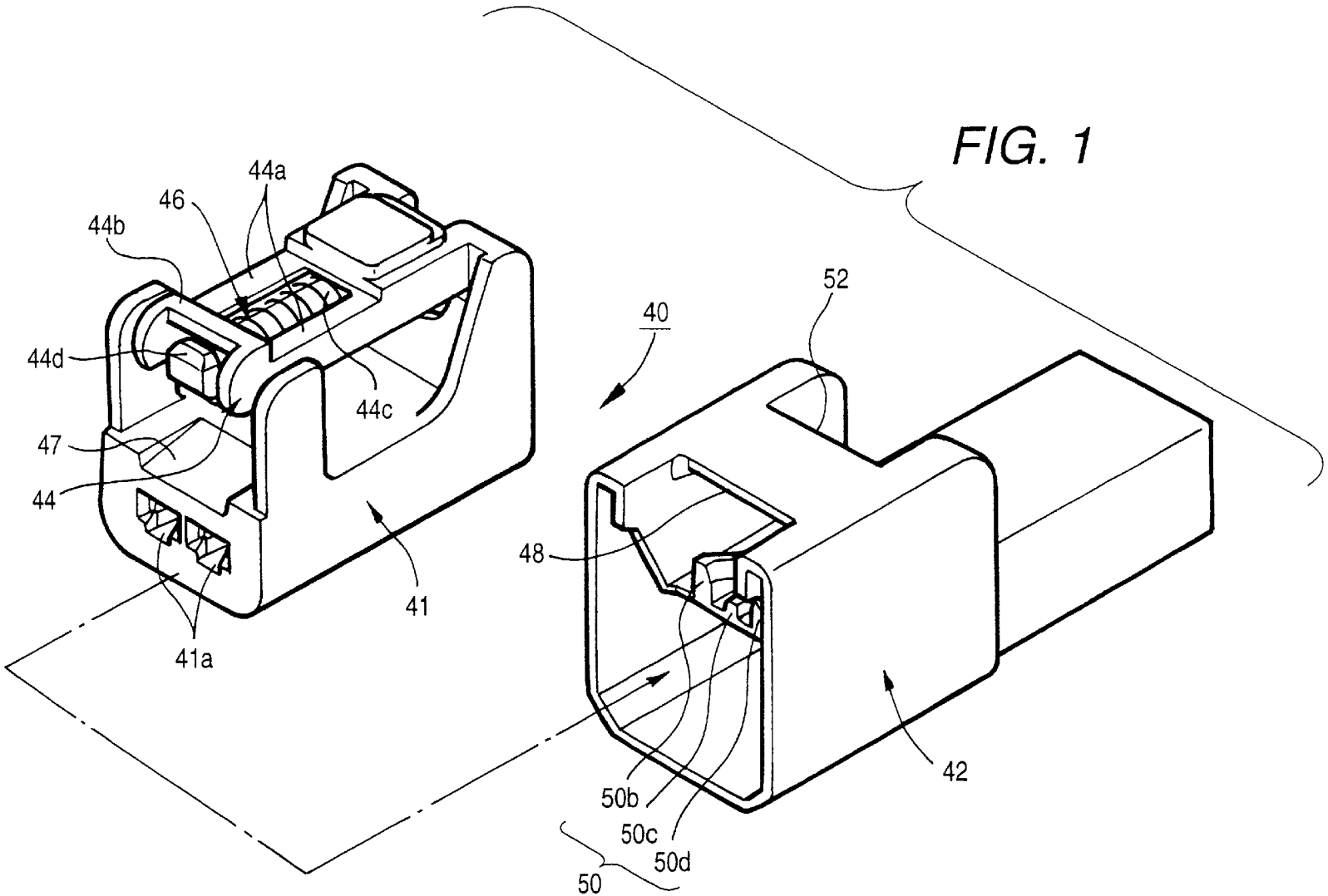
FIG. 1 is an exploded, perspective view of a first embodiment of a half-fitting prevention connector of the present invention.

In the half-fitting prevention connector 40 of this first embodiment, as shown in FIG. 1, a half-fitted condition is positively prevented by a disengaging force produced between the pair of male and female connector housings 41 and 42 to be fittingly connected together.

The male connector housing 41 has an elastic lock arm 44 extending in a direction of fitting of the male and female connector housings 41 and 42 relative to each other, and a return spring 46 is supported on the lock arm 44 so as to be contracted along a length of the lock arm 44.

The female connector housing 42 includes an arm guide portion 48 for elastically deforming the lock arm 44 toward an outer surface of the housing in a half-fitted condition of the male and female connector housings 41 and 42, a spring abutment portion 50, which abuts against one end of the return spring 46 during the connector fitting operation, with the lock arm 44 elastically deformed toward the outer surface of the housing, so as to resiliently deform the return spring 46, thereby producing a disengaging force urging the two connectors away from each other, and an arm retaining portion 52 which retains an engagement projection 44*b* on the lock arm 44 to lock the male and female connector housings 41 and 42 in a fitted condition when the two connector housings 41 and 42 are completely fitted together as a result of cancellation of the elastic deformation of the lock arm 44 by the arm guide portion 48.

Figure 2:
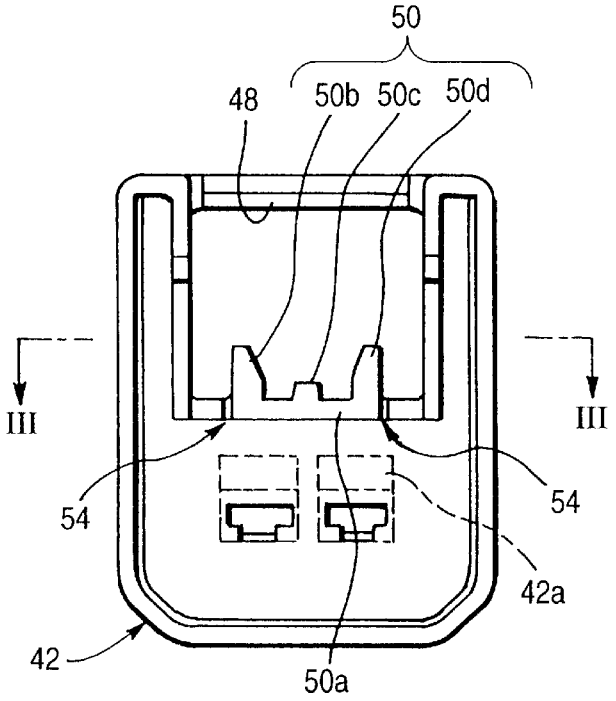
FIG. 2 is a front-elevational view of a female connector housing shown in FIG. 1.

As shown in FIG. 1, the male connector housing 41 has terminal receiving chambers 41*a* formed therethrough, and female connection terminals (not shown) are received in these chambers 41*a*, respectively. As shown in FIG. 2, the female connector housing 42 has terminal receiving chambers 42*a* formed therethrough, and male connection terminals (not shown) are received in these chambers 42*a*, respectively.

As shown in FIG. 1, the lock arm 44 includes a pair of elastic arms 44*a*, which extend upwardly from a rear end of the male connector housing 41, and further extend toward a front end thereof along the outer surface of this housing 41, the engagement projection 44*b* formed on and projecting upwardly from distal ends of the elastic arms 44*a*, and a spring mounting portion 44*c* provided in a space between the elastic arms 44*a*.

The spring mounting portion 44*c* is a cantilever portion extending from the proximal ends of the elastic arms 44*a* toward the distal ends thereof, and when the elastic arms 44*a* are elastically deformed, the spring mounting portion 44*c* is displaced together with the elastic arms 44*a*. A retainer portion 44*d* is formed at a distal end of the spring mounting portion 44*c*, and serves to prevent the return spring 46, wound on this spring mounting portion 44*c*, from being disengaged therefrom.

In this embodiment, the return spring 46 comprises a compression coil spring, and is wound on the spring mounting portion 44*c* of the lock arm 44. Therefore, the return spring 46 is supported on the lock arm 44 so as to contract along the length of the lock arm 44, and when the lock arm 44 is elastically displaced, the return spring 46 is displaced together with this lock arm 44.

Merely by mounting the return spring 46 (comprising an inexpensive compression coil spring) on the spring mounting portion 44*c*, the return spring 46 can be easily supported on the lock arm 44 so as to contract along the length of this lock arm. Therefore, the assembling operation is easy, and the cost can be reduced.

From an initial stage of the housing fitting operation until the amount of fitting of the two housings relative to each other reaches a predetermined value, so that the completely-fitted condition is obtained, the arm guide portion 48 elastically deforms the elastic arms 44*a* and the spring mounting portion 44*c* toward the outer surface of the housing. A tapering guide surface for facilitating the entry of the engagement projection 44*b* is formed at a front end of the arm guide portion 48 at a lower edge thereof.

Figure 3:
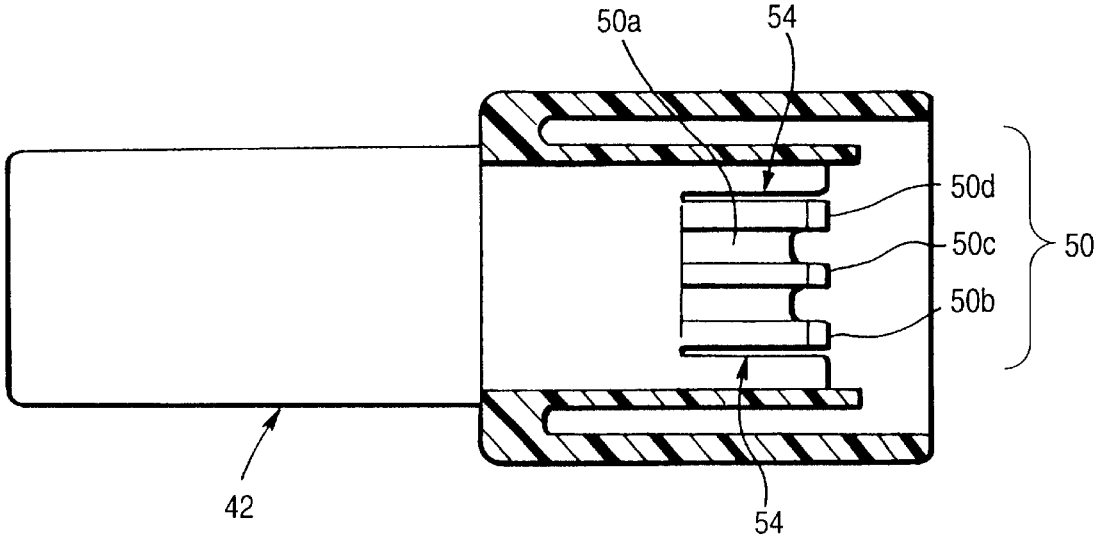
FIG. 3 is a cross-sectional view taken along the line III—III of FIG. 2.

As shown in FIGS. 1 to 3, an elastic portion 50*a* extends at a front end of an upper wall of the housing in the connector fitting direction, and three projections 50*b*, 50*c* and 50*d*, forming the spring abutment portion 50, are formed on a distal end portion of this elastic portion 50*a*. The two outer projections 50*b* and 50*d* are higher than the inner or central projection 50*c*. This arrangement is adopted in accordance with the shape of the outer periphery of the return spring 46 comprising a compression coil spring.

As shown in FIGS. 2 and 3, the elastic portion 50*a*, on which the spring abutment portion 50 is formed, is separated at its opposite sides from the upper wall of the housing by a pair of slits 54 and 54, so that this elastic portion 50*a* can be elastically displaced in the direction of the thickness of the upper wall of the housing. When the lock arm 44 is elastically deformed toward the outer surface of the housing, the elastic portion 50*a* is pressed and elastically deformed through the return spring 46, disposed above the spring abutment portion 50, toward the inside of the housing, that is, in a direction perpendicular to the connector fitting direction.

Figure 4A:
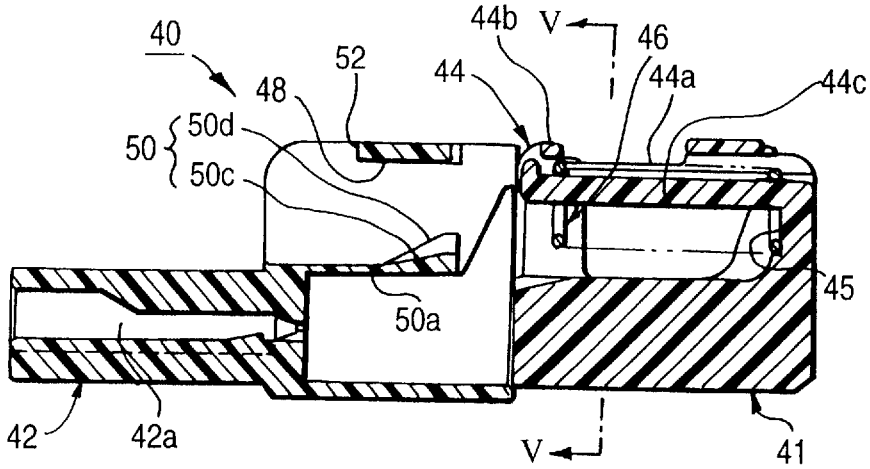
FIGS. 4A to 4D are vertical cross-sectional views showing the operation of various portions at the time of fitting the male and female connector housings of FIG. 1 together.
Figure 4B:
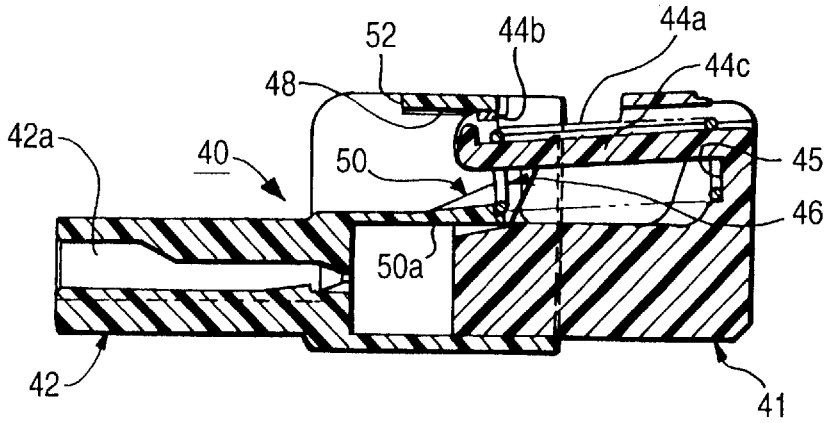

When the operation for fitting the male and female connector housings 41 and 42 together is started, the engagement projection 44*b* of the lock arm 44, formed on the male connector housing 41, is pressed down (FIG. 4) toward the outer surface of the housing by the arm guide portion 48, formed on the female connector housing 42, at an initial stage of this connector fitting operation, so that the elastic arms 44*a* are elastically deformed toward the outer surface of the housing, as shown in FIGS. 4A and 4B. Incidentally, when the male and female connector housings 41 and 42 are disengaged from each other, or are completely fitted together, the elastic arms 44*a* are not elastically deformed, in which case the return spring 46 is disposed in an upper position where this return spring 46 does not interfere with the spring abutment portion 50, as shown in FIG. 5.

Then, when the two connectors are fitted together, with the lock arm 44 elastically deformed toward the outer surface of the housing, the one end of the return spring 46, wound or supported on the spring mounting portion 44*c* formed integrally with the elastic arms 44*a*, abuts against the spring abutment portion 50 formed on the female connector housing 42.

Figure 4C:
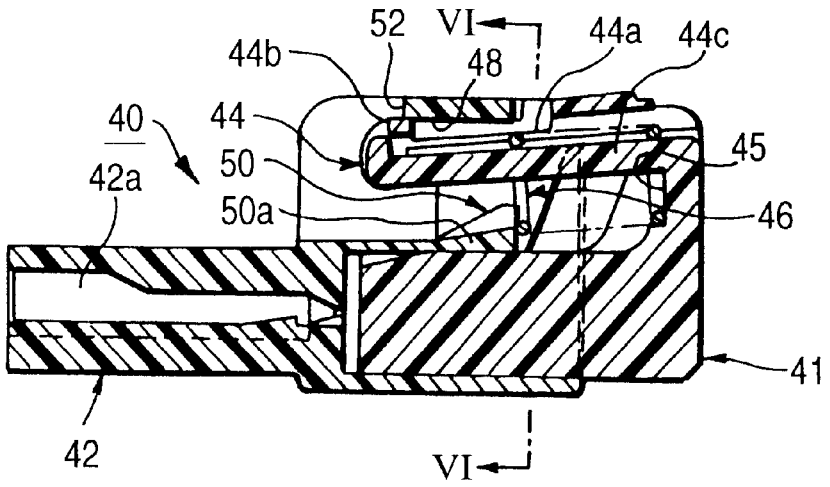
Figure 5:
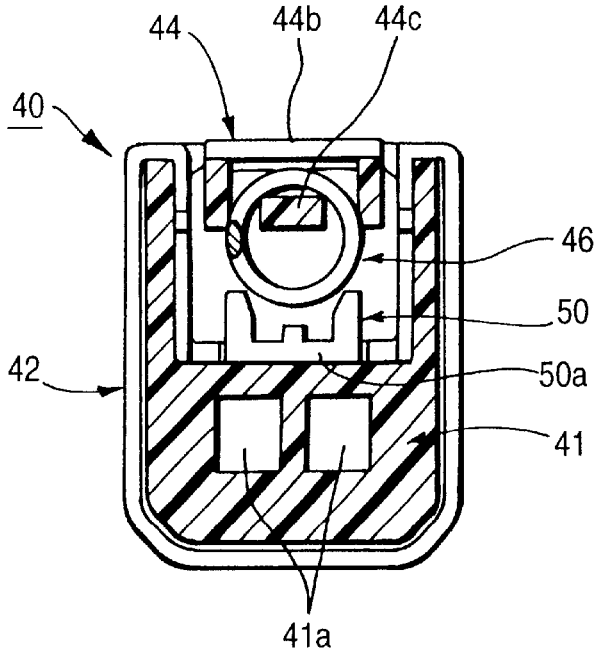
FIG. 5 is a cross-sectional view taken along the line V—V of FIG. 4A.
Figure 6:
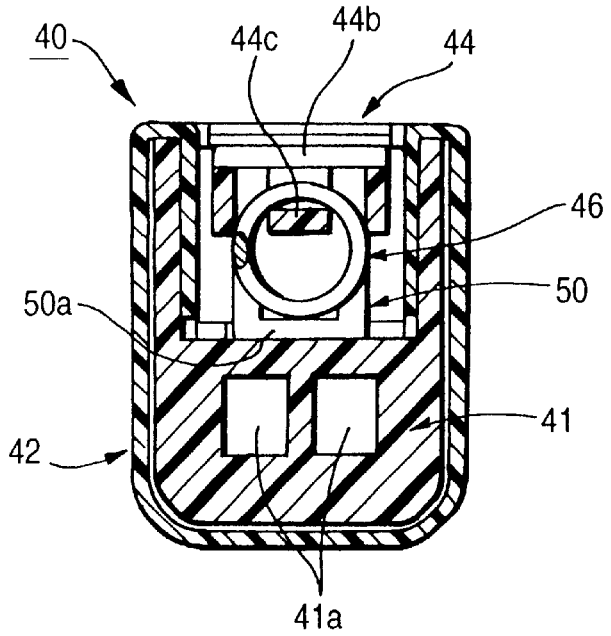
FIG. 6 is a cross-sectional view taken along the line VI—VI of FIG. 4C.

Therefore, as shown in FIGS. 4C and 6, the return spring 46 is compressed between the spring abutment portion 50 and a spring bearing portion 45, formed on the inner surface of at the proximal ends of the elastic arms 44*a*, in accordance with the amount of fitting of the male and female connector housings 41 and 42 relative to each other, and therefore a restoring force of the return spring 46 serves as a disengaging force tending to disengage the two connector housings from each other, and the male connector housing 41 is pushed into the female connector housing 42 against the bias of the return spring 46.

Therefore, when the operation for pushing the male connector housing 41 into the female connector housing 42 is stopped in this half-fitted condition, the male and female connector housings 41 and 42 are pushed back relative to each other in a disengaging direction, opposite to the fitting direction, by the resilient force (bias) of the return spring 46 urging the two connector housings away from each other, and therefore this half-fitted condition can be easily detected.

Figure 4D:
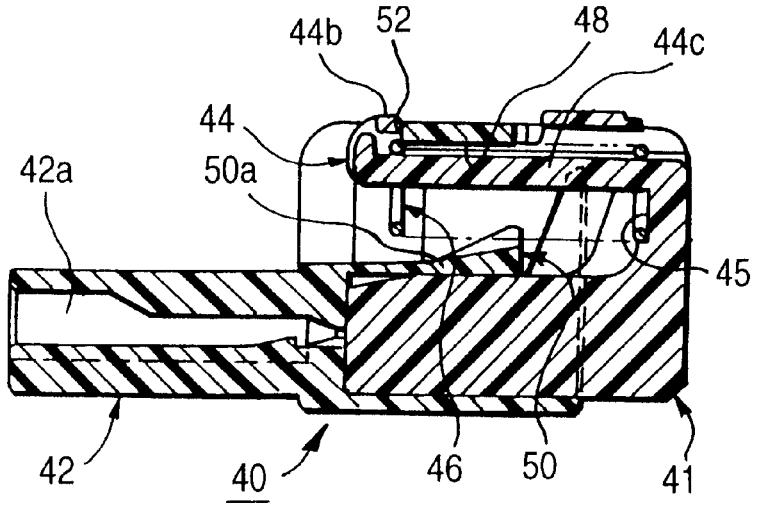

Then, the operation for fitting the male and female connector housings 41 and 42 together further proceeds, and when the amount of fitting of the male and female connector housings 41 and 42 relative to each reaches the predetermined vale, so that the two connector housings are completely fitted together, the engagement projection 44*b* of the lock arm 44 is disengaged from the lower surface of the arm guide portion 48 as shown in FIG. 4D, and therefore the elastic deformation of the elastic arms 44*a* is canceled, and the lock arm 44 is restored into its initial position where this lock arm 44 is spaced from the outer surface of the housing.

As a result, the return spring 46, held by the elastic arms 44*a* of the lock arm 44, moves apart from the outer surface of the housing together with the elastic arms 44*a*, so that the one end of the return spring 46 is disengaged from the spring abutment portion 50, and therefore the disengaging force of the return spring 46, produced by the compression between the spring bearing portion 45 and the spring abutment portion 50, is canceled.

At the same time, the engagement projection 44*b* of the lock arm 44 is retained by the arm retaining portion 52 (defined by a vertical surface) formed at the rear end of the arm guide portion 48, so that the male and female connector housings 41 and 42 are locked to each other in a fitted condition.

Figure 7A:
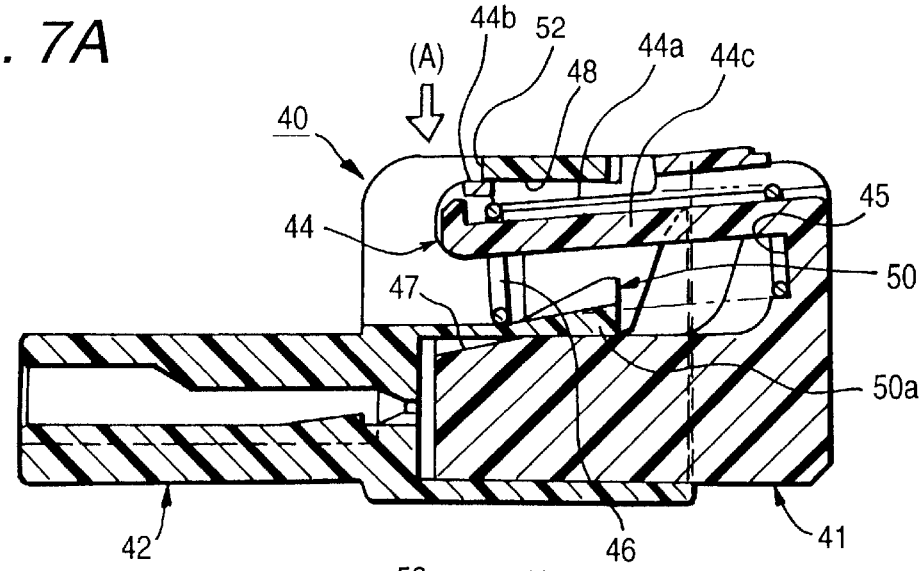
FIGS. 7A to 7C are vertical cross-sectional views showing the operation of the various portions at the time of disengaging the male and female connector housings of FIG. 1 from each other.

For canceling the fitted condition of the male and female connector housings 41 and 42, first, the lock arm 44 is pressed by the finger or the like to be elastically deformed toward the outer surface of the housing (that is, in a direction of arrow (A)), thereby disengaging the engagement projection 44*b* from the arm retaining portion 52, as shown in FIG. 7A.

Figure 7B:
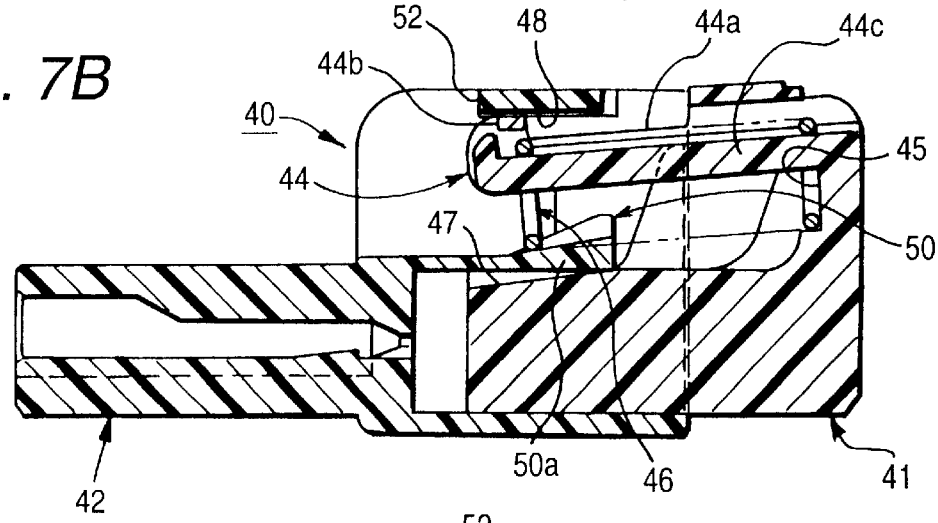
Figure 7C:
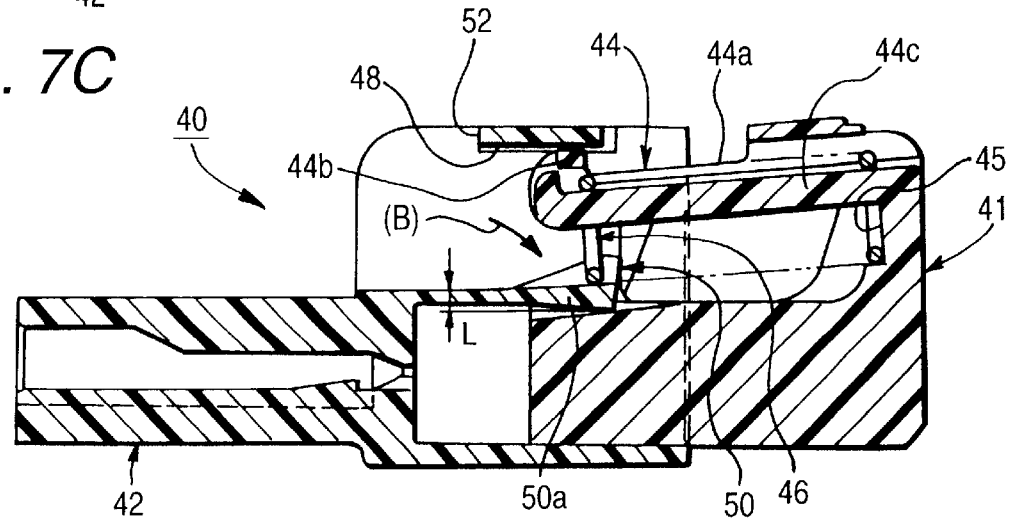

Then, the male connector housing 41 is withdrawn from the female connector housing 42 as shown in FIG. 7B. At this time, when the outer peripheral portion of the return spring 46 abuts against the upper side of the spring abutment portion 50, the spring abutment portion 50, formed on and projecting from the elastic portion 50*a*, is elastically displaced a suitable distance L toward the inside of the housing so as not to limit the retracting movement of the return spring 46 as shown in FIG. 7C, thus securing a space for the passage of the return spring 46 therethrough. A notch or recess 47 is formed in that portion of the upper surface of the upper wall of the male connector housing 41 to be opposed to the elastic portion 50*a*, and this notch 47 serves as a relief space for allowing the elastic deformation of the elastic portion 50*a*.

Therefore, during the operation for disengaging the male and female connector housings 41 and 42 from each other, the return spring 46 will not be caught by the spring abutment portion 50, so that the operating force, required for the withdrawing operation, will not increase. Therefore, the male connector housing 41 can be smoothly withdrawn from the female connector housing 42, and therefore the male and female connector housings 41 and 42 can be easily disengaged from each other.

However, in this embodiment, using the compression coil spring as the return spring 46, the return spring 46 itself can be crushed radially inwardly, and therefore even with the type of construction in which the spring abutment portion 50 can not be elastically displaced, the disengagement of the male and female connector housings 41 and 42 from each other will not be hindered, and the half-fitting prevention connector of the present invention is not limited to the above embodiment. On the other hand, in the case where a spring, bent into a zigzag shape, such as the return spring 30 of FIG. 17, is used as the return spring, this spring itself can be crushed in the elastically-deforming direction, and therefore it is necessary to provide the elastically-displaceable spring abutment portion 50 and spring relief portions 66 (described later).

Figure 14:
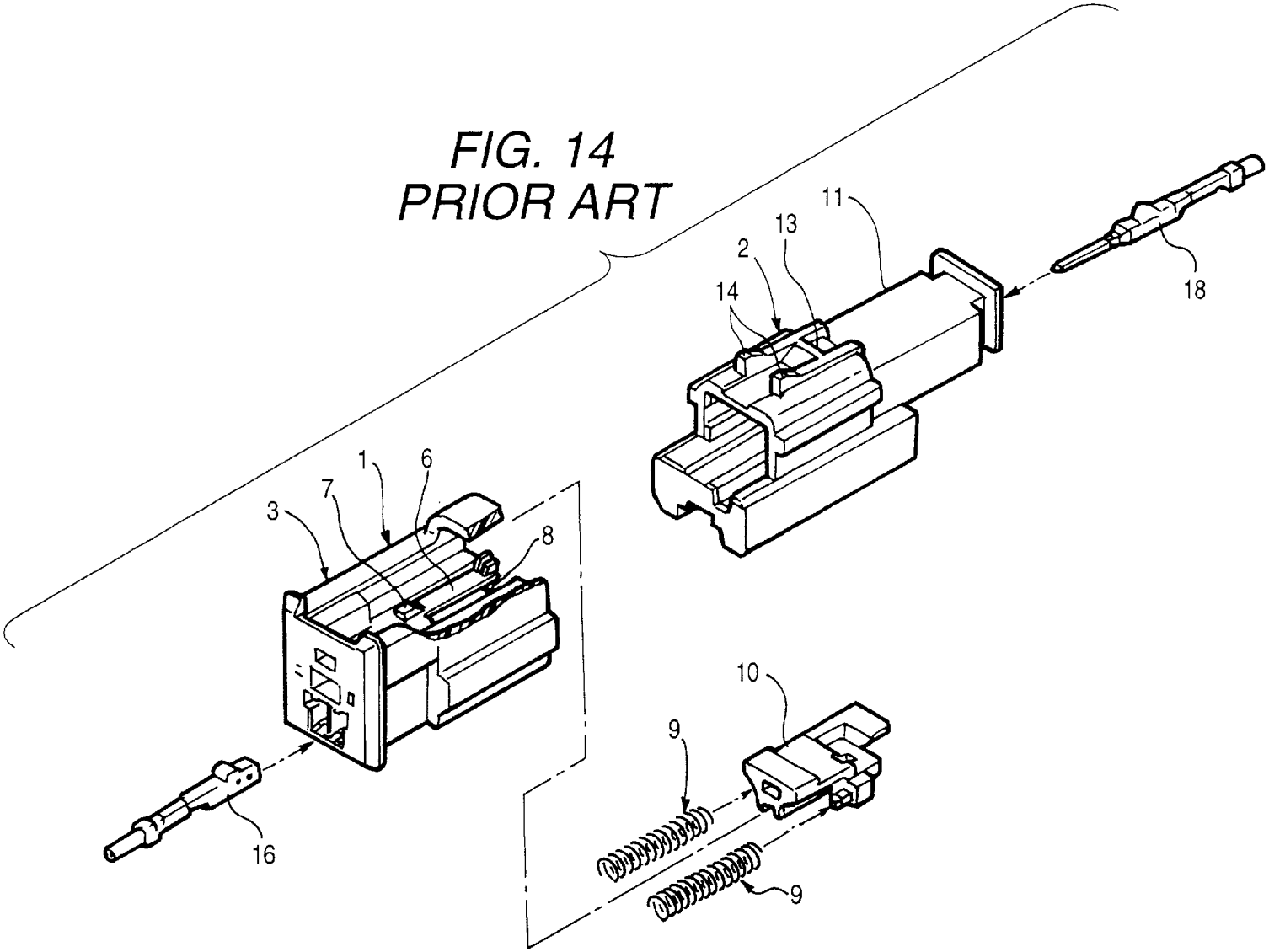
FIG. 14 PRIOR ART
FIG. 14 is an exploded, perspective view of a conventional half-fitting prevention connector.
Figure 15:
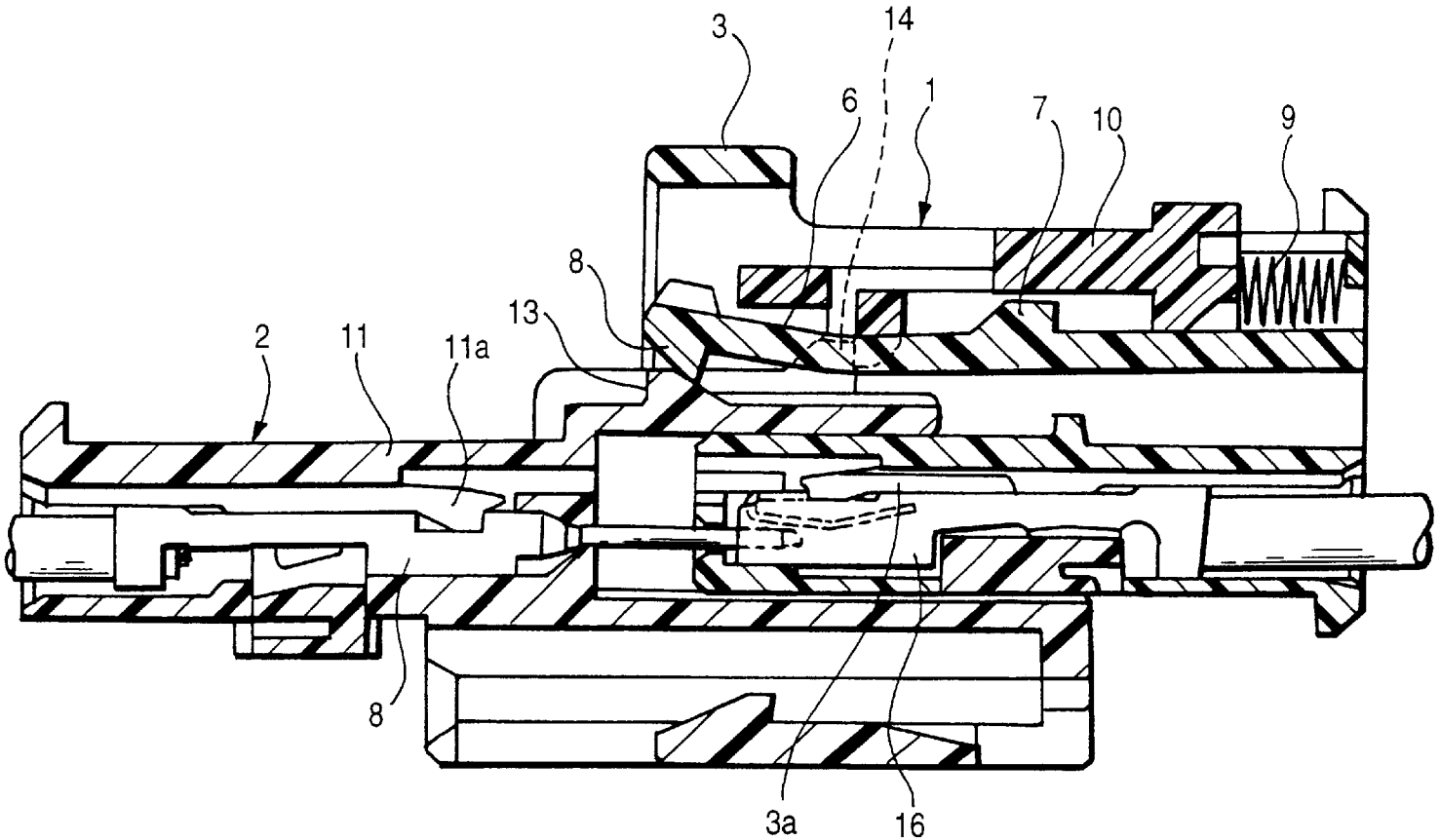
FIG. 15 PRIOR ART
FIG. 15 is a vertical cross-sectional view of the half-fitting prevention connector of FIG. 14 in a half-fitted condition.
Figure 16:
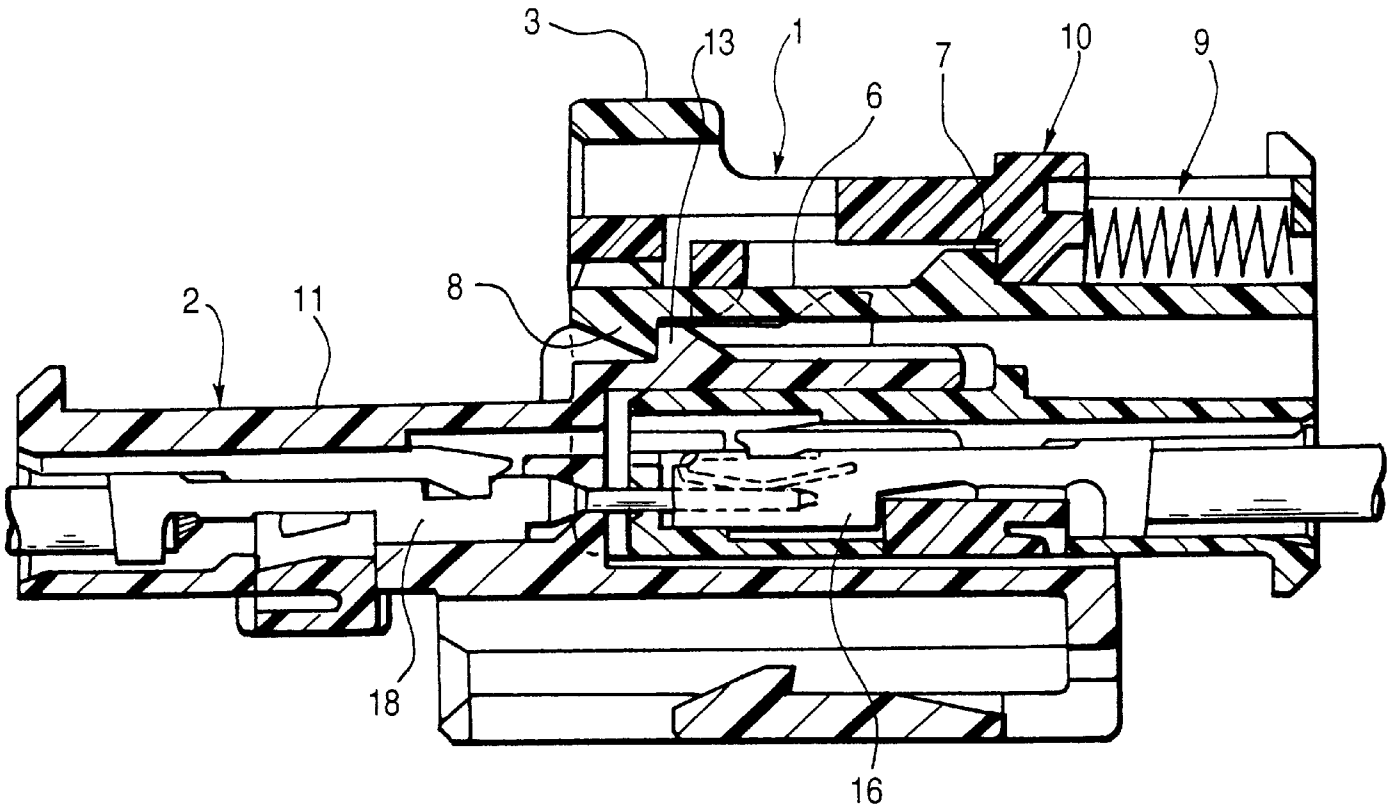
FIG. 16 PRIOR ART
FIG. 16 is a vertical cross-sectional view of the half-fitting prevention connector of FIG. 14 in a completely-fitted condition.

Namely, in the half-fitting prevention connector 40 of this embodiment, any slider (as used in the conventional half-fitting prevention connector of FIG. 14), separate from the connector housing, is not used, and only one spring member is required for producing the disengaging force, and therefore the number of the component parts, as well as the number of the steps of the assembling process, is reduced, and therefore the cost can be reduced.

Figure 17:
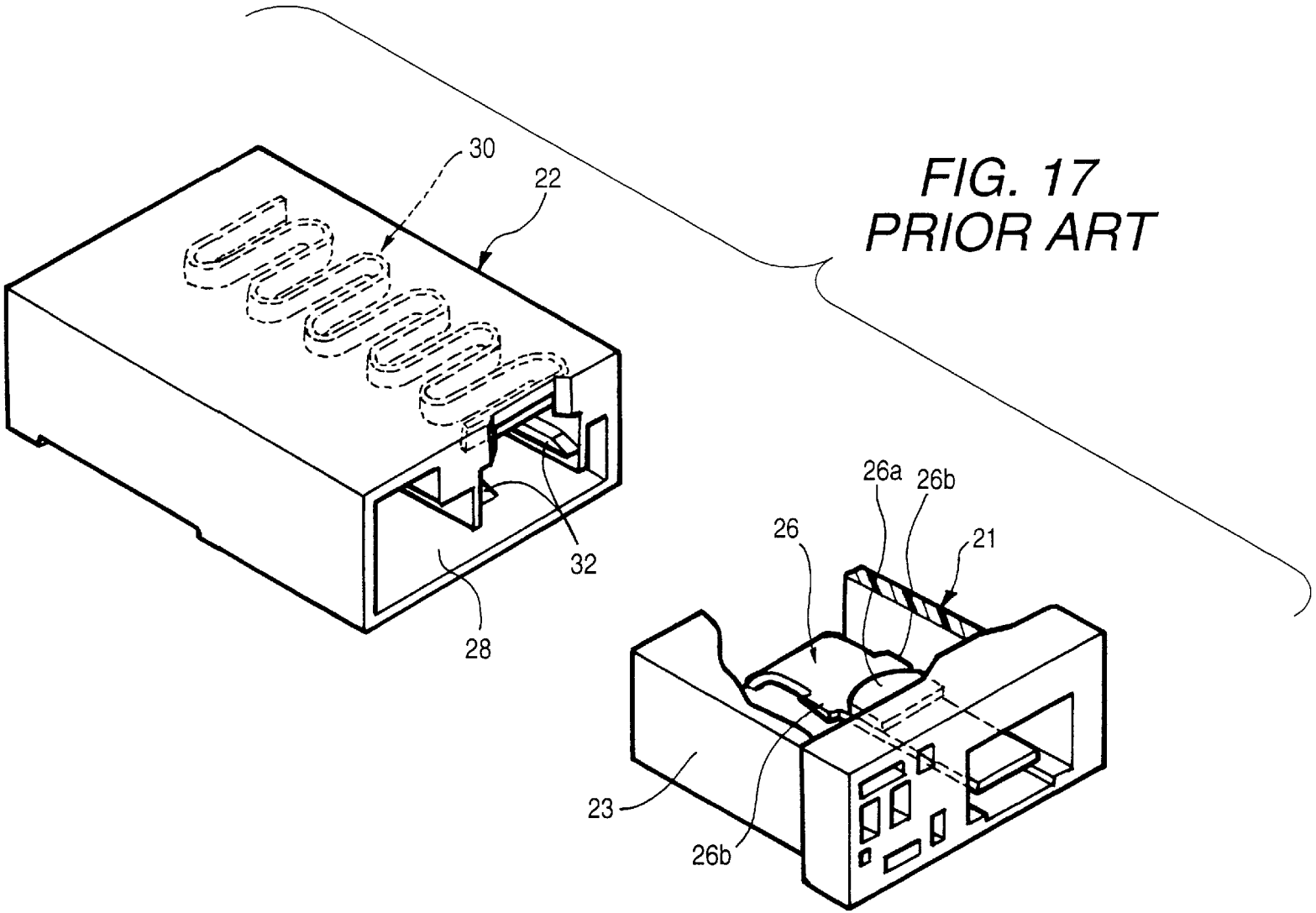
FIG. 17 PRIOR ART
FIG. 17 is an exploded, perspective view of another conventional half-fitting prevention connector.
Figure 18A:
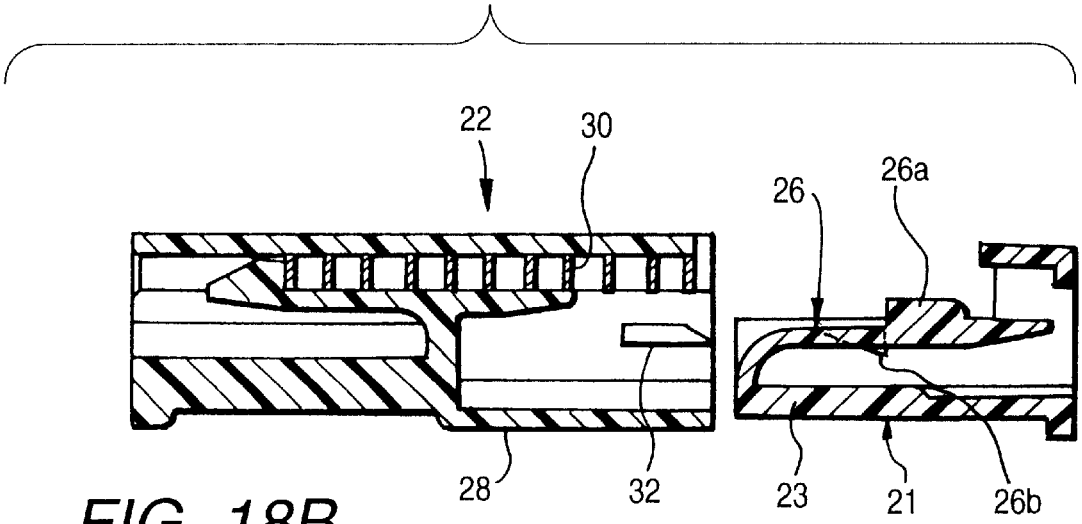
FIG. 18A PRIOR ART
FIGS. 18A to 18C are vertical cross-sectional views showing the operation of various portions at the time of fitting male and female connector housings of FIG. 17 together.
Figure 18B:
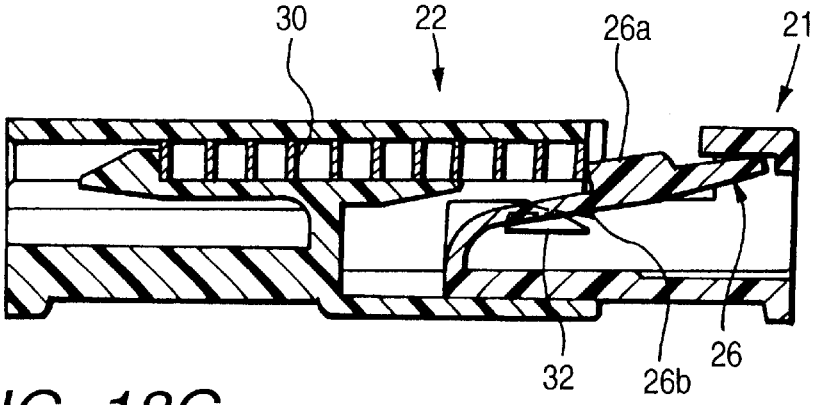
FIG. 18B PRIOR ART
Figure 18C:
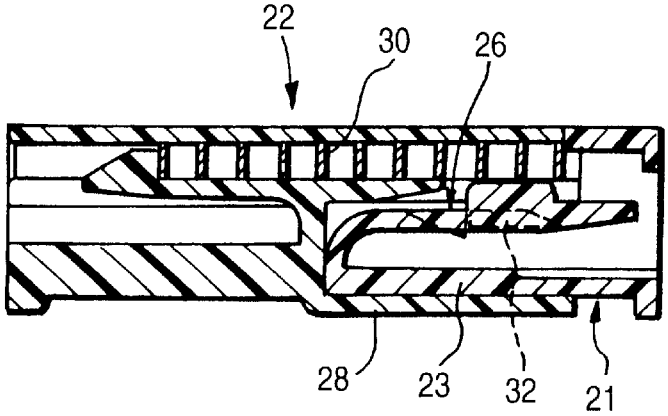
FIG. 18C PRIOR ART

And besides, during the time when the male and female connector housings 41 and 42 are fitted together and disengaged from each other, the lock arm 44 is elastically deformed only in the predetermined direction (that is, in the direction toward the outer surface of the housing) relative to the arm guide portion 48, and the amount of elastic deformation of the lock arm 44 within the mating housing can be kept to a smaller value as compared with the conventional half-fitting prevention connector of FIG. 17.

Therefore, damage of the lock arm 44 due to excessive deformation is suitably prevented, and besides the size of the connector will not be increased by the provision of a space for allowing the displacement of the lock arm 44.

2. Second Embodiment

A preferred second embodiment of a half-fitting prevention connector of the present invention will now be described in detail with reference to FIGS. 8 to 13.

Figure 8:
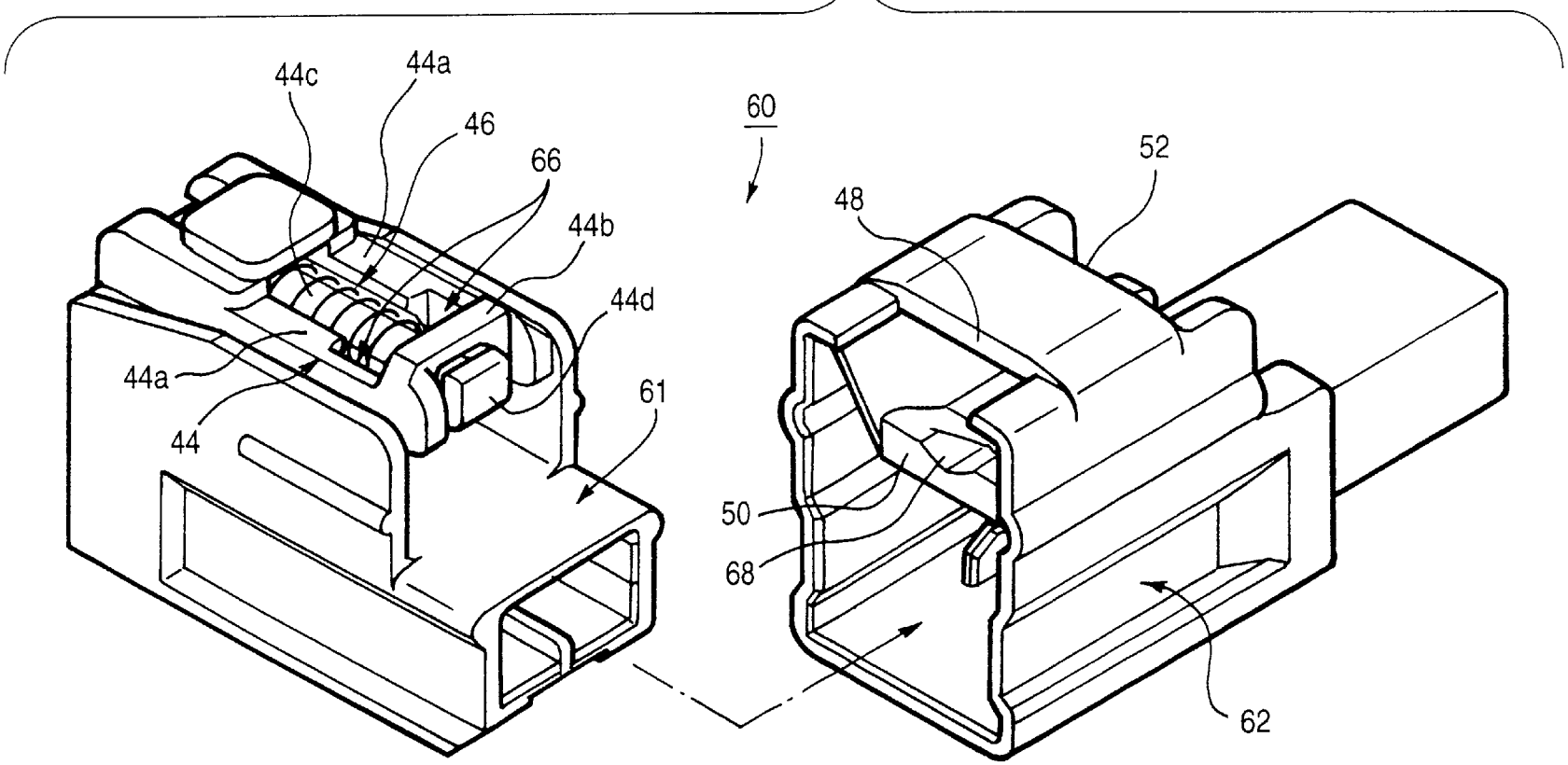
FIG. 8 is an exploded, perspective view of a second embodiment of a half-fitting prevention connector of the present invention.

In the half-fitting prevention connector 60 of this second embodiment, as shown in FIG. 8, a half-fitted condition is positively prevented by a disengaging force produced between the pair of male and female connector housings 61 and 62 to be fittingly connected together.

The male and female connector housings 61 and 62 are obtained by modifying part of the male and female connector housings 41 and 41 of the first embodiment, and therefore those portions, similar to those of the male and female connector housings of the first embodiment, will be designated by identical reference numerals, respectively, and detailed explanation thereof will be omitted while only the modified portions will be described in detail.

Figure 9:
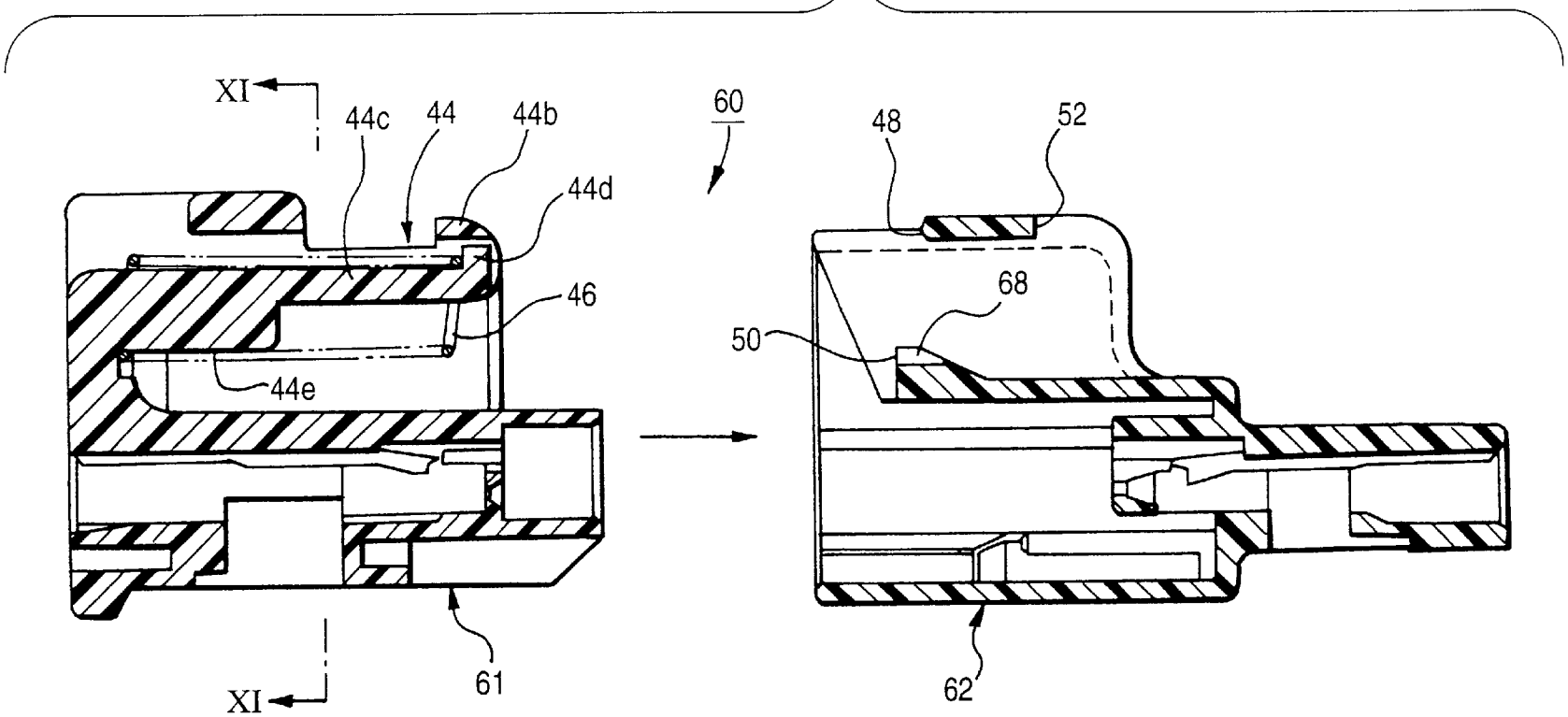
FIG. 9 is a vertical cross-sectional view of the half-fitting prevention connector of FIG. 8.

In the half-fitting prevention connector 60 of this second embodiment, as shown in FIG. 9, the male connector housing 61 has an elastic lock arm 44 extending in a direction of fitting of the male and female connector housings 41 and 42 relative to each other, and a spring fixing portion 44*e* is formed on a proximal end portion of the lock arm 44, and this spring fixing portion 44*e* serves to prevent a return spring 46 (comprising a compression coil spring) from being biased or displaced in a direction perpendicular to the connector fitting direction.

Figure 11:
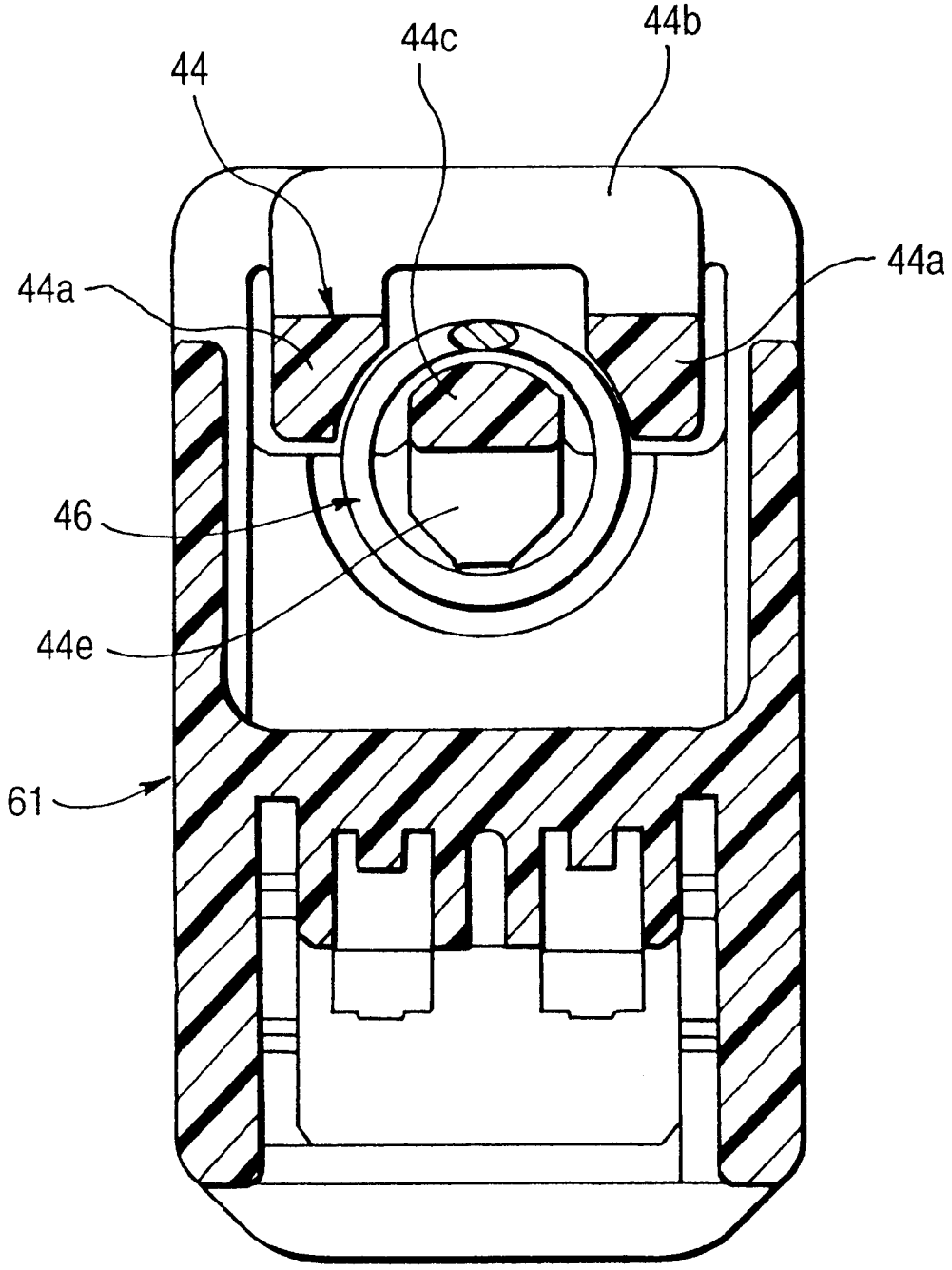
FIG. 11 is a cross-sectional view taken along the line XI—XI of FIG. 9.

As shown in FIG. 11, the spring fixing portion 44*e* is defined by a proximal end portion of a cantilever-type spring mounting portion 44*c* (on which the return spring (compression coil spring) 46 is wound) which is increased to a thickness close to the inner diameter of the return spring 46. The distal end portion of the spring mounting portion 44*c* is formed into such a small thickness that the return spring 46 can be elastically displaced as in the first embodiment. Another purpose of this construction is to enable the distal (front) end portion of the return spring 46 to be elastically deformed into the spring relief portions 66 at the time of canceling the locked condition of the two connectors.

The spring relief portions 66 are formed in the distal end portion of the lock arm 44, and these spring relief portions 66 allow the resilient deformation of the return spring 46 pressed by a spring abutment portion 50 toward the outside of the housing in a direction perpendicular to the connector fitting direction.

Figure 10:
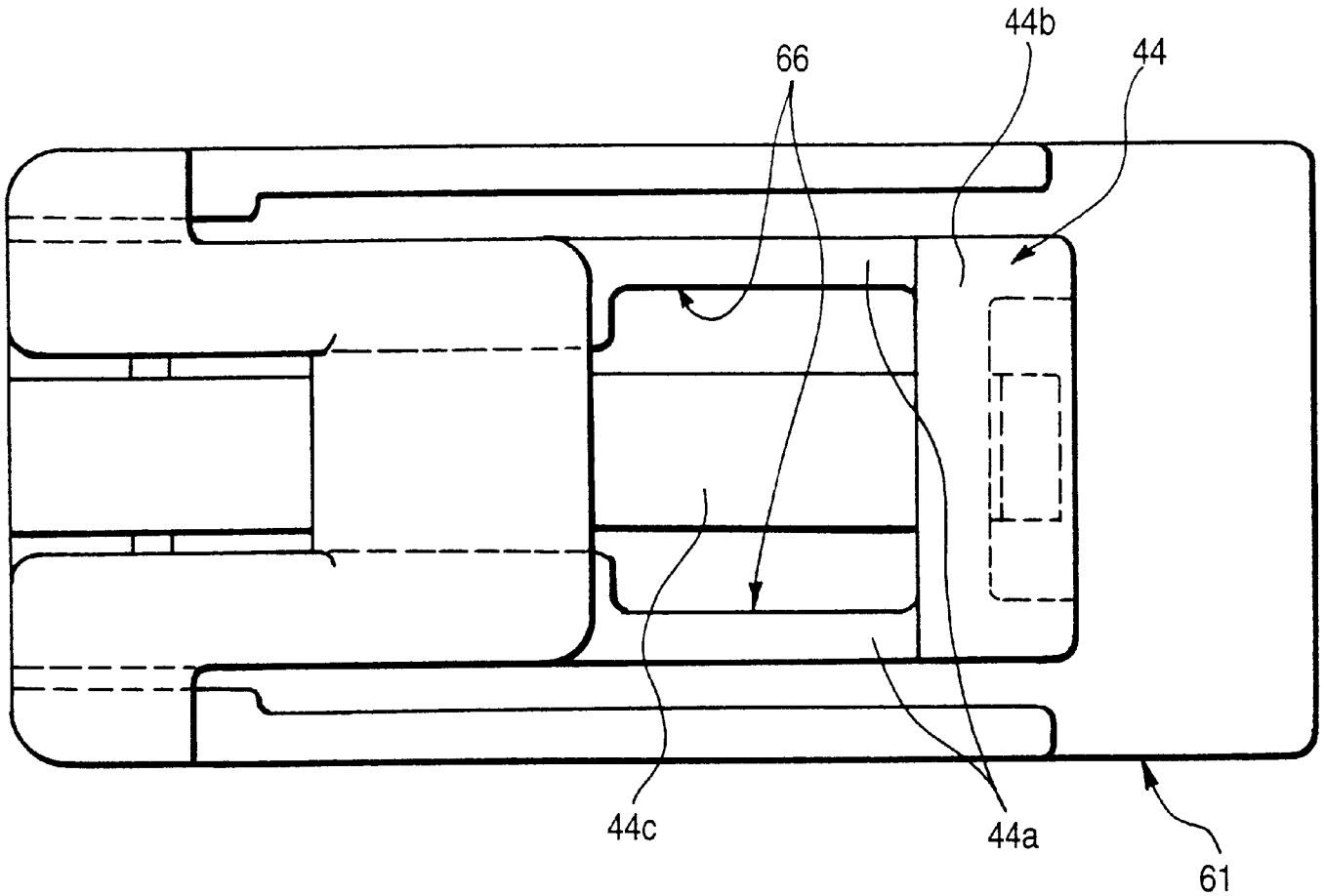
FIG. 10 is a plan view of a male connector housing shown in FIG. 8.

As shown in FIG. 10, notches, defining the spring relief portions 66, respectively, are formed respectively in inner surfaces of distal end portions of a pair of elastic arms 44*a* and 44*a* disposed respectively on the opposite sides of the spring mounting portion 44*c*, and these notches have such a size as to allow the passage of the return spring 46 therethrough.

As shown in FIG. 8, the spring abutment portion 50 is defined by a thickened portion which is formed on a front end of an upper wall of the female connector housing 62, and has a curved surface 68 having a bottom disposed centrally of the width of the female connector housing 62. Unlike the spring abutment portion of the first embodiment, this spring abutment portion 50 will not be elastically displaced.

In this construction in which the spring fixing portion 44*e* is formed on the proximal end portion of the lock arm 44 as described above, the return spring 46, mounted on the lock arm 44, is prevented from shaking upon application of external vibrations and so on.

Figure 12:
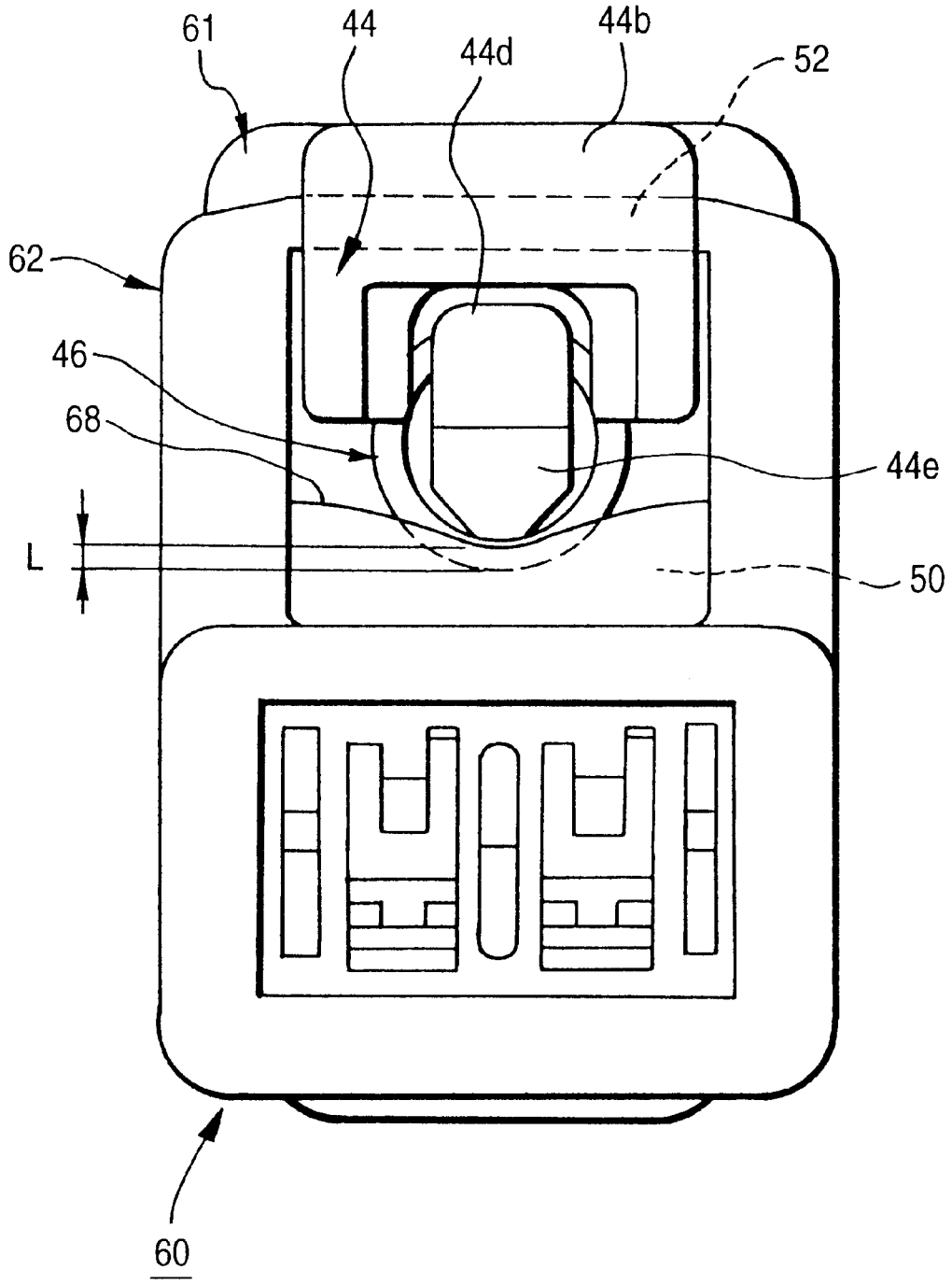
FIG. 12 is a right side-elevational view of the half-fitting prevention connector of FIG. 8 shown upside down in a fitted condition.

And besides, even when the male and female connector housings 61 and 62 are fitted together upside down as shown in FIG. 12, the return spring 46 will not hang down from the spring mounting portion 44*c* because of its own weight, and therefore the one end of the return spring 46 is prevented from being displaced or biased in a direction to decrease the amount of engagement thereof with the spring abutment portion 50 of the female connector housing 62, and therefore the one end of the return spring 46 can abut against the spring abutment portion 50 with a proper engagement amount L.

Therefore, in the half-fitting prevention connector 60 of this second embodiment, the compression of the return spring 46 can be positively effected by the spring abutment portion 50 in a half-fitted condition regardless of the posture of the male and female connector housings 61 and 62 fitted together, and therefore the more positive disengaging force can be secured.

Figure 13:
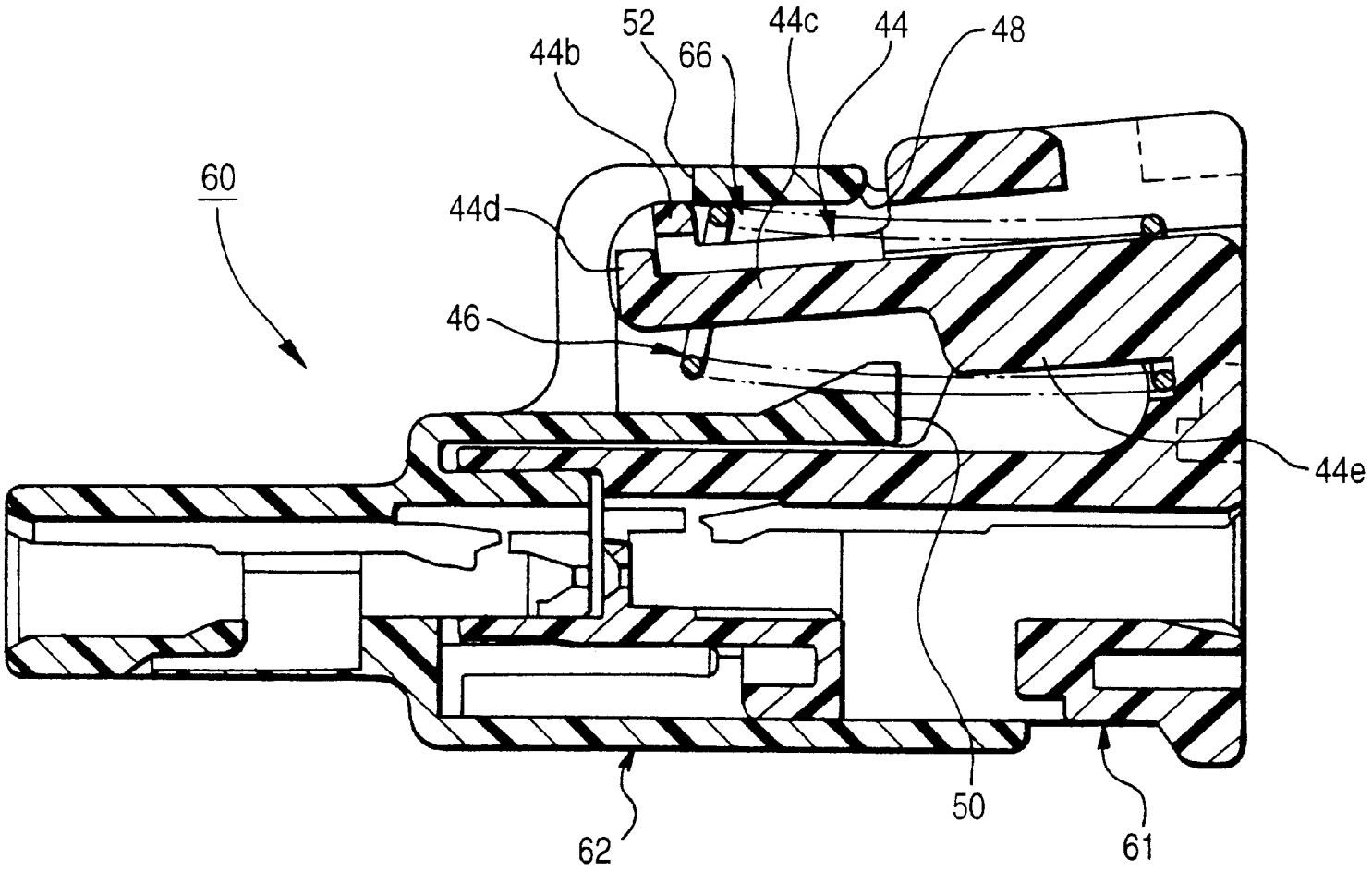
FIG. 13 is a vertical cross-sectional view showing the operation of various portions at the time of disengaging the male and female connector housings of FIG. 8 from each other.

The spring relief portions 66 are formed in the distal end portion of the lock arm 44 as described above, and with this construction, even if the return spring 46, supported on the lock arm 44, is brought into engagement with the spring abutment portion 50 when the lock arm 44 is elastically deformed toward the outer surface of the housing to thereby disengage an engagement projection 44*b* from an arm retaining portion 52 so as to cancel the fitted condition of the male and female connector housings 61 and 62, the distal end portion of the return spring 46 can be elastically deformed toward the outside of the housing (that is, upwardly in FIG. 13) so as not to limit the retracting movement of the return spring 46, as shown in FIG. 13. Thus, the distal end portion of the return spring 46 can be displaced relative to the distal end portion of the lock arm 44 to escape into the spring relief portions 66.

Therefore, during the operation for disengaging the male and female connector housings 61 and 62 from each other, the return spring 46 will not be caught by the spring abutment portion 50, and therefore the operating force, required for this withdrawing operation, will not increase. Therefore, the male and female connector housings 61 and 62 can be easily disengaged from each other.

Incidentally, the distal end portion of the return spring 46 is resiliently deformed to escape into the spring relief portions 66 as a result of engagement of the outer peripheral surface of the return spring 46 with the upper wall of the female connector housing 62 at the time of pressing the distal end portion of the lock arm 44 by the finger or the like so as to cancel the locked condition. Such resilient deformation of the return spring 46 will not occur when the male and female connector housings 61 and 62 begin to be fitted together. Therefore, the provision of the spring relief portions 66 will not decrease the amount of engagement of the one end of the return spring 46 with the spring abutment portion 50 during the fitting of the male and female connector housings 61 and 62 relative to each other.

In the half-fitting prevention connectors of the present invention, the connector housings, the lock arm, the return spring, the arm guide portion, the spring abutment portion, the arm retaining portions and so on are not limited to those of the above embodiments, but can take various suitable forms within the scope of the present invention.

For example, the return spring is not limited to the compression spring 46 in the above embodiments, but can comprise a spring, bent into a zigzag shape, such as the return spring 30 of FIG. 17, or any other suitable known spring.

In the half-fitting prevention connector of the present invention, at the initial stage of the connector fitting operation, the elastic lock arm, formed on the one connector housing, is elastically deformed toward the outer surface of the housing by the arm guide portion formed on the other connector housing.

Then, when the two connectors are fitted together, with the lock arm elastically deformed toward the outer surface of the housing, the one end of the return spring, supported on the lock arm, abuts against the spring abutment portion, formed on the other connector housing, so that the return spring is resiliently deformed, and therefore the two connectors are pushed relative to each other in the fitting direction against the bias of the return spring.

When the pushing operation is stopped in this half-fitted condition, the two connectors are pushed back relative to each other in the disengaging direction, opposite to the fitting direction, by the resilient force (bias) of the return spring urging the two connectors away from each other, and therefore this half-fitted condition can be easily detected.

Then, when the amount of fitting of the two connector housings relative to each reaches the predetermined vale, so that the two connector housings are completely fitted together, the elastic deformation of the lock arm by the arm guide portion is canceled, and the lock arm is restored into its initial position where this lock arm is spaced from the outer surface of the housing.

As a result, the return spring, held on the lock arm, moves apart from the outer surface of the housing together with the lock arm, so that the one end of the return spring is disengaged from the spring abutment portion. At the same time, the engagement projection of the lock arm is retained by the arm retaining portion formed on the other connector housing, so that the two connector housings are locked to each other in a fitted condition.

Namely, any slider, separate from the connector housing, is not used, and only one spring member is required for producing the disengaging force, and therefore the number of the component parts, as well as the number of the steps of the assembling process, is reduced, and therefore the cost can be reduced.

And be sides, during th e connector fitting operation and the connector disengaging operation, the lock arm is elastically deformed only in the predetermined direction relative to the arm guide portion, and the amount of elastic deformation of the lock arm can be kept to a smaller value. Therefore, damage of the lock arm due to excessive deformation is suitably prevented, and besides the size of the connector will not be increased by the provision of the space for allowing the displacement of the lock arm.

Therefore, there can be provided the half-fitting prevention connection of a compact, inexpensive design in which a half-fitted condition is positively prevented by the disengaging force, produced between the pair of connector housings to be fittingly connected together, without increasing the number of the component parts, and the connector can be positively locked to the mating connector in a mutually-fitted condition.

What is claimed is:

1. A half-fitting prevention connector, comprising:

a pair of connector housings fittable to each other;

an elastic lock arm formed on one of the connector housings, the lock arm extending in a fitting direction of the connector housings;

an engagement projection formed on the lock arm;

a return spring contractibly supported on the lock arm along a longitudinal direction of the lock arm;

an arm guide portion disposed on the other one of connector housings, the arm guide portion causing the lock arm to deform elastically toward an outer surface of the one of the connector housings in a half-fitted condition of the connector housings;

a spring abutment portion formed on the other one of connector housings, the spring abutment portion abutting against one end portion of the return spring during connector fitting operation, so that the lock arm is elastically deformed toward the outer surface of the one of the connector housings while causing the return spring to resiliently deform, thereby producing a disengaging force urging the connector housings away from each other; and an arm retaining portion disposed on the other one of connector housings, the arm retaining portion retaining the engagement projection of the lock arm to lock the connector housings when the connector housings are completely fitted to each other after an elastic deformation of the lock arm is cancelled by the arm guide portion.

2. A half-fitting prevention connector according to claim 1, wherein the spring abutment portion projects from an elastic portion which can be elastically displaced when the spring abutment portion is pressed through the return spring toward an inside of the other one of the connector housings in a direction substantially perpendicular to the fitting direction of the connector housings.

3. A half-fitting prevention connector according to claim 1, wherein the return spring comprises a compression coil spring wound on the lock arm.

4. A half-fitting prevention connector according to claim 2, wherein the return spring comprises a compression coil spring wound on the lock arm.

5. A half-fitting prevention connector according to claim 3, further comprising a spring fixing portion, which is formed on a proximal end portion of the lock arm, and which limits the return spring from being biased in a direction substantially perpendicular to the fitting direction of the connector housings.

6. A half-fitting prevention connector according to claim 4, further comprising a spring fixing portion, which is formed on a proximal end portion of the lock arm, and which limits the return spring from being biased in a direction substantially perpendicular to the fitting direction of the connector housings.

7. A half-fitting prevention connector according to claim 3, further comprising a spring relief portion located at a distal end portion of the lock arm, the spring relief portion allowing a resilient deformation of the return spring pressed by the spring abutment portion toward an outside of the one of the connector housings in a direction substantially perpendicular to the fitting direction of the connector housings.

8. A half-fitting prevention connector according to claim 4, further comprising a spring relief portion located at a distal end portion of the lock arm, the spring relief portion allowing a resilient deformation of the return spring pressed by the spring abutment portion toward an outside of the one of the connector housings in a direction substantially perpendicular to the fitting direction of the connector housings.

9. A half-fitting prevention connector according to claim 5, further comprising a spring relief portion located at a distal end portion of the lock arm, the spring relief portion allowing a resilient deformation of the return spring pressed by the spring abutment portion toward an outside of the one of the connector housings in a direction substantially perpendicular to the fitting direction of the connector housings.

10. A half-fitting prevention connector according to claim 6, further comprising a spring relief portion located at a distal end portion of the lock arm, the spring relief portion allowing a resilient deformation of the return spring pressed by the spring abutment portion toward an outside of the one of the connector housings in a direction substantially perpendicular to the fitting direction of the connector housings.

* * * * *